US005704291A

United States Patent [19]

Lewis

[11] Patent Number: 5,704,291

[45] Date of Patent: Jan. 6, 1998

[54] LITHOGRAPHIC PRINTING MEMBERS WITH DEFORMABLE CUSHIONING LAYERS

[75] Inventor: Thomas E. Lewis, New Hampstead, N.H.

[73] Assignee: Presstek, Inc., Hudson, N.H.

[21] Appl. No.: 594,335

[22] Filed: Jan. 30, 1996

[51] Int. Cl.[6] ..... B41N 1/14

[52] U.S. Cl. ..... 101/457; 101/376; 101/456; 430/302

[58] Field of Search ..... 101/376, 395, 101/401, 401.1, 453, 460, 465, 467, 456, 457, 462; 430/302, 303

[56] References Cited

U.S. PATENT DOCUMENTS

| | | | |
|---|---|---|---|
| 3,136,636 | 6/1964 | Dowdall et al. | 101/456 |
| 3,765,330 | 10/1973 | Gundlach | 101/219 |
| 4,112,841 | 9/1978 | Deshpande | 101/460 |
| 4,114,535 | 9/1978 | Deshpande | 101/454 |
| 4,478,931 | 10/1984 | Fickes et al. | 101/401.1 |
| 4,574,697 | 3/1986 | Feeley | 101/401.1 |
| 4,582,777 | 4/1986 | Fischer et al. | 101/401.1 |
| 4,718,340 | 1/1988 | Love, III | 101/467 |
| 4,729,310 | 3/1988 | Love, III | 101/466 |
| 5,323,702 | 6/1994 | Vrotacoe et al. | 101/376 |
| 5,339,737 | 8/1994 | Lewis et al. | 101/454 |

FOREIGN PATENT DOCUMENTS

| | | | |
|---|---|---|---|
| 2015929 | 9/1979 | United Kingdom | 101/376 |
| 9207716 | 5/1992 | WIPO . | |

*Primary Examiner*—Stephen R. Funk
*Attorney, Agent, or Firm*—Cesari and McKenna, LLP

[57] ABSTRACT

Printing members resistant to handling damage include a porous compressible layer that deforms in response to applied forces, inhibiting overlying layers from tearing or scratching. One type of construction involves ablation-type printing members, wherein pulses from a heat source ablate one or more layers to expose (or facilitate exposure of by cleaning) an underlying layer. A second type of construction utilizes traditional photoexposure-type layers that harden or increase adhesion to adjacent layers in response to actinic radiation. The compressible layer is typically located below the radiation-responsive or imaging layer, but may also serve as that layer.

33 Claims, 3 Drawing Sheets

LITHOGRAPHIC PRINTING MEMBERS WITH DEFORMABLE CUSHIONING LAYERS

BACKGROUND OF THE INVENTION

1. Field of the Invention

The present invention relates to digital printing apparatus and methods, and more particularly to lithographic printing members for use with laser-discharge imaging devices.

2. Description of the Related Art

Lithographic printing members, which may take a variety of forms, are capable of recording an image defined by regions exhibiting differential affinities for ink and/or fountain solution; typical configurations include the traditional planar or curved lithographic plates that are mounted on the plate cylinder of a printing press, but can also include seamless cylinders (e.g., the roll surface of a plate cylinder), an endless belt, or other arrangement.

In a dry printing system, the printing member is simply inked and the image transferred onto a recording material. In a wet lithographic system, the non-image areas are hydrophilic, and the necessary ink-repellency is provided by an initial application of a dampening (or "fountain") solution to the plate prior to inking. The ink-abhesive fountain solution prevents ink from adhering to the non-image areas, but does not affect the oleophilic character of the image areas.

The printing member is ordinarily carried on (or itself defines) a rotating plate cylinder that receives ink (and, in wet systems, dampening solution) from suitable conveying assemblies. The printing member transfers ink in the imagewise pattern to a compliant intermediate surface called a blanket cylinder, which, in turn, applies the image to the paper or other recording medium. In typical sheet-fed press systems, the recording medium is pinned to an impression cylinder, which brings it into contact with the blanket cylinder.

The press ordinarily contains multiple printing members, each corresponding to a different color, and each associated with a separate station including a plate cylinder, blanket cylinder and impression cylinder. The recording material is transferred among the print stations sequentially, each station applying a different ink color to the material to produce a composite multi-color image.

The printing member can be imaged in different ways. In ablation-type systems, pulses from a heat source ablate one or more layers to expose (or facilitate exposure of by cleaning) an underlying layer. Traditional photoexposure-type printing members rely on imagewise exposure of a photopolymer to actinic radiation that hardens it or increases its adhesion to adjacent layers, so that subsequent photochemical development easily removes unexposed polymer. The result, in either case, is an imagewise pattern of ink-accepting and ink-repellent regions (in the case of dry plates), or ink-accepting and water-accepting regions (in the case of wet plates).

For example, as described in U.S. Pat. No. 5,339,737 (the entire disclosure of which is hereby incorporated by reference), the printing-member construction may include a first layer and a substrate underlying the first layer, the substrate being characterized by efficient absorption of infrared ("IR") radiation, and the first layer and substrate having different affinities for ink or an ink-abhesive fluid. Laser radiation is absorbed by the substrate, and ablates the substrate surface in contact with the first layer; this action disrupts the anchorage of the substrate to the overlying first layer, which is then easily removed at the points of exposure. The result of removal is an image spot whose affinity for ink or the ink-abhesive fluid differs from that of the unexposed first layer.

In a variation of this embodiment, the first layer, rather than the substrate, absorbs IR radiation. In this case the substrate serves a support function and provides contrasting affinity characteristics.

In both of these two-ply embodiments, a single layer serves two separate functions, namely, absorption of IR radiation and interaction with ink or an ink-abhesive fluid. In a second embodiment, these functions are performed by two separate layers. The first, topmost layer is chosen for its affinity for (or repulsion of) ink or an ink-abhesive fluid. Underlying the first layer is a second layer, which absorbs IR radiation. A strong, durable substrate underlies the second layer, and is characterized by an affinity for (or repulsion of) ink or an ink-abhesive fluid opposite to that of the first layer. Exposure of the printing member to a laser pulse ablates the absorbing second layer, weakening the topmost layer as well. As a result of ablation of the second layer, the weakened surface layer is no longer anchored to an underlying layer, and is easily removed. The disrupted topmost layer (and any debris remaining from destruction of the absorptive second layer) is removed in a post-imaging cleaning step. This, once again, creates an image spot having an affinity for ink or an ink-abhesive fluid differing from that of the unexposed first layer.

An alternative to the foregoing constructions that provides improved performance in some circumstances is disclosed in U.S. Pat. No. 5,353,705 (the entire disclosure of which is hereby incorporated by reference), which introduces a "secondary" ablation layer that volatilizes in response to heat generated by ablation of one or more overlying layers. In a typical construction, a radiation-absorbing layer underlies a surface coating chosen for its interaction with ink and/or fountain solution. The secondary ablation layer is located beneath the absorbing layer, and may be anchored to a substrate having superior mechanical properties. It may be preferable in some instances to introduce an additional layer between the secondary ablation layer and the substrate to enhance adhesion therebetween.

Photoexposure-type printing members are quite widespread and have been in use for decades.

An accurate printed image, of course, requires more than reliable imaging; the printing member must be free of surface and structural imperfections that themselves mar the imagewise pattern. Particularly in the case of traditional, planar constructions that are individually taken from storage and mounted to plate cylinders, printing members are vulnerable to damage at numerous handling stages. Among the most problematic of all types of damage is scratching, since this represents a permanent disruption of the image that cannot be mitigated by stretching or flattening the printing member against the plate cylinder.

DESCRIPTION OF THE INVENTION

Brief Summary of the Invention

The present invention concerns both ablation-type and photoexposure-type printing members, improving their ability to withstand impact abrasion. Constructions within the former category to which the invention may be applied are set forth in the '737 and '705 patents and U.S. Pat. No. 5,379,698 (the entire disclosure of which are hereby incorporated by reference). All of the printing-member constructions disclosed in those patents incorporate materials that enhance the ablative efficiency of the laser beam. The disclosed materials are all solid (i.e., fully solid or gelatinous, but non-liquid) and durable, enabling them to withstand the rigors of commercial printing and exhibit adequate useful lifespans.

The present invention is straightforwardly applied to this type of printing member. In one embodiment, a topmost layer overlies a layer that ablates (i.e., decomposes into gases and volatile fragments) in response to a pulse of imaging radiation, which itself overlies a compressible cushioning layer that is sufficiently thick to serve as a substrate. The compressible layer absorbs forces applied to the overlying layers, permitting them to stretch into the compressible layer rather than suffering penetration. Preferably, the compressible layer has a porous structure with internal voids (i.e., pockets of air or other gas) that readily collapse in response to applied forces. In a variation to this embodiment, the compressible layer is bonded to a heavier underlying substrate.

In an alternative approach, the imaging layer is not ablative, but instead responds to actinic radiation by hardening or increasing its adhesion to adjacent layers in the manner of a traditional photoexposure-type printing member.

In another, simpler embodiment, compressibility and ablation are combined into a single layer. In one variant of this approach, a topmost layer and the underlying compressible layer exhibit opposite affinities for ink or an ink-abhesive fluid. The compressible layer is partially ablated by an imaging pulse, facilitating ready removal of overlying (and now detached) portions of the topmost layer. The compressible layer can serve as the substrate, or can instead be bonded to another layer underneath. In a second variation, the compressible layer is completely ablated, exposing a substrate therebeneath. In this case, the topmost layer and the substrate exhibit opposite affinities for ink or an ink-abhesive fluid.

Deformation of the compressible layer may be elastic or inelastic. An elastic compressible layer possesses a porous structure that collapses in response to a force, but springs back substantially to its undisturbed conformation. An inelastic layer does not recover following removal of the force; like styrofoam, it retains the conformation into which it was compressed. Both types of compressible layer are useful over a wide range of applications; however, certain limiting parameters are important in designing optimal constructions for specific environments. If deformations are likely to be severe, inelastic layers will foster retention of depressions in which ink can puddle, degrading the printed image. Elastic layers are best used in conjunction with organic imaging layers, particularly those that are themselves elastomeric in nature. Although elastic layers can also be used with metal layers, even thin metal layers exhibit some ductility, and the tendency of elastic layers to recover their shapes can degrade an already-distorted metal layer further through recompression.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1:
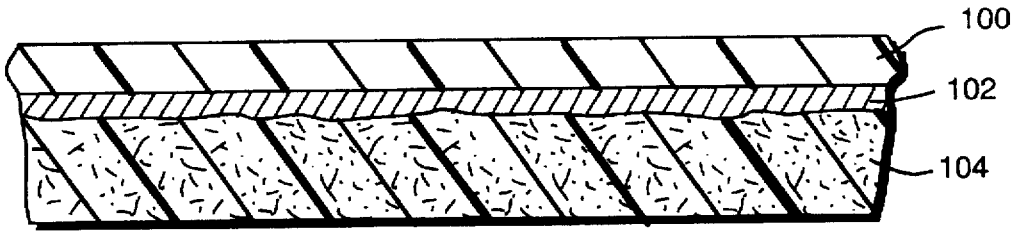
FIG. 1 is an enlarged sectional view of a first embodiment of the invention.
Figure 2A:
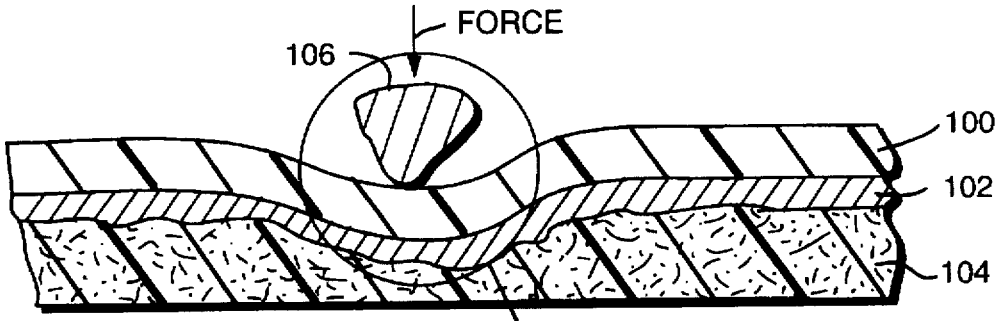
FIG. 2A shows the manner in which the embodiment illustrated in FIG. 1 reacts to application of an impinging force.
Figure 2B:
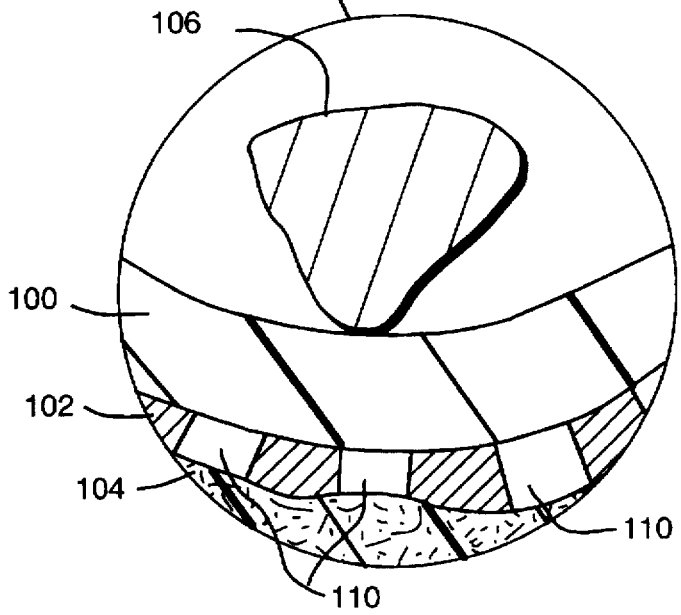
FIG. 2B is a detail showing the manner in which a metal imaging layer can undergo crazing.

Refer first to FIGS. 1, 2A and 2B, which show the construction of a representative embodiment as well as the manner in which the invention inhibits delamination of a metal layer from adjacent elastic layers. The construction includes a surface coating layer 100, a layer 102 capable of absorbing imaging (preferably IR) radiation, and a deformable cushioning layer 104, which in this embodiment is sufficiently thick to serve as a substrate.

In the illustrated embodiment, absorbing layer 102 is metal, comprising at least one very thin (preferably 300 Å or less) layer of titanium; it should be understood, however, that polymeric materials can be used instead; polymeric systems that intrinsically absorb in the near-IR region or polymeric coatings into which near-IR-absorbing components have been dispersed or dissolved are acceptable.

Useful metal imaging layers are preferably deposited to an optical density ranging from 0.2 to 1.0, with a density of 0.6 being especially preferred. However, thicker layers characterized by optical densities as high as 2.5 can also be used to advantage. An optical density of 0.6 generally corresponds to a layer thickness of 300 Å or less. While titanium is preferred as layer 102, alternative metals include alloys of titanium, aluminum, alloys of aluminum, nickel, iron, chromium, and others exhibiting the required optical densities and adequate radiation absorption.

Representative polymeric imaging layers include nitrocellulose materials, polymers such as polyester loaded with radiation-absorptive pigments (such as carbon black), conductive polymers (such as the ICP-117 polypyrrole-based conductive material supplied by Polaroid Corp. Commercial Chemicals, Assonet, Mass., or Americhem Green #34384-C3, a proprietary polyaniline-based conductive coating supplied by Americhem, Inc., Cuyahoga Falls, Ohio), or polymers containing nigrosine in particulate or solubilized form. Other examples are set forth in the '737 and '691 patents.

Layers 100 and 104 exhibit opposite affinities for ink or an ink-abhesive fluid. In one version of this plate, surface layer 100 is an oleophobic material (e.g., a fluoropolymer or, preferably, silicone) that repels ink, while layer 104 is an oleophilic material; the result is a dry plate. In a second, wet-plate version, surface layer 100 is a hydrophilic material such as a polyvinyl alcohol (e.g., the Airvol 125 material supplied by Air Products, Allentown, Pa.), while substrate 104 is both oleophilic and hydrophobic. It should be noted that hydrophilic polymers tend to be vulnerable to cracking; accordingly, for wet-plate constructions, the amount of compressibility must be carefully controlled.

Layer 104 is polymeric in nature and also exhibits a compressible porous structure that is elastic or inelastic. This layer can be formed from a wide range of polymer systems using foaming techniques well-known in the art. In one approach, readily available "blowing agents" (e.g., azides) are combined with the base polymer prior to its curing; the blowing agent or agents release gas that becomes trapped in the polymer matrix as it cures, thereby "foaming" the polymer to produce permanent voids. Polyurethanes are suitable for this purpose, responding well to blowing agents and offering the necessary oleophilicity to accept ink; they can also be formulated to exhibit hydrophobicity for wet-plate applications. As used herein, the term "polyurethane" is intended to broadly connote polymers prepared by reacting polyisocyanates with components containing active hydrogen atoms, e.g., polyhydroxyl (polyol), polyamine, polycarboxyl-functional or polyamido-functional components. Following combination of these components the foam is formed and "locked" into place by rapid reaction to yield a rigid, infusible (thermoset) polymeric system.

Alternatively, the pre-cured polymer resin can be combine with suitably sized bubbles or beads. For example, hollow "microspheres" or "microballoons" (e.g., in the 25–250μsize range) formed from soda lime glass or sodium silicate are compressible in bulk and can themselves provide the necessary voids; dispersing them in suitable concentration confers inelastic compressibility without chemical reaction or modification to the base polymer.

Alternatively, polymer microspheres (e.g., the UCAR phenolic microballoons supplied by Union Carbide Corporation, Danbury, Conn.) can be utilized. These typically expand upon heating; dispersing them in the polymer resin and curing the microsphere-containing composition in the heated state results in additional void space as the microspheres shrink. Suppliers of useful microspheres include the Grace Syntactics division of W. R. Grace & Co., Pierce & Stevens Corp., Emerson & Cumming, Fillite, P.A. Industries, PQ Corp. and 3M Co.

Another alternative is certain pigmented compositions that tolerate deformation, such as the white 329 film supplied by ICI Films, Wilmington, Del., which utilizes IR-reflective barium sulfate as the white pigment.

Because layer 104 serves as a substrate, it is preferably at least 5 mils thick. Layer 104 can also provide a "secondary ablation" function as described in the '705 patent. In this approach, layer 104 exhibits limited thermal stability and partially ablates in response to heat generated by overlying layer 102. As a secondary ablation, layer 104 can, for example, prevent charring of any additional layer(s) located therebeneath, and preferably does not interact substantially with imaging radiation. It should ablate "cleanly"—that is, exhibit sufficient thermal instability as to decompose rapidly and uniformly upon application of heat, evolving primarily gaseous decomposition products. Preferred materials undergo substantially complete thermal decomposition (or pyrolysis) with limited melting or formation of solid decomposition products, and are typically based on chemical structures that readily undergo, upon exposure to sufficient thermal energy, eliminations (e.g., decarboxylations) and rearrangements producing volatile products.

If layer 104 is to provide a secondary ablation function, it can be fabricated from a foamed acrylic for inelastic behavior, or from a foamed polyurethane for elastic behavior.

Alternatively, a separate secondary ablation layer can be located between layers 102 and 104. The additional layer should be elastomeric, and polyurethanes are therefore preferred for this purpose.

One type of behavior that this embodiment may undergo, in the case involving a metal imaging layer, is shown in FIGS. 2A and 2B. An impinging hard object 106 presses against surface layer 100, causing that layer and layer 102 to deform into compressible layer 104. As shown in FIG. 2B, however, deformation of layer 102 results in crazing, opening cracks 110 within the (now deformed) plane of the material, as well as some elongation due to metal ductility. So long as adhesion between layer 102 and adjacent layers 100 and 104 are sufficiently strong and the cracks 110 sufficiently small, an inelastic compressible layer 104 will retain layer 102 in a condition of minimal damage that does not interfere with proper imaging.

The construction can also employ a metal layer not to absorb laser radiation, but to reflect it. For example, as described in the '737 patent at cols. 18 and 19, a metal layer can be interposed between an organic imaging layer 102 and layer 104 to reflect imaging radiation back into layer 102. In this case, the considerations discussed above in connection with FIG. 2B apply as well.

The illustrated embodiment can also be modified along the lines of a traditional photoexposure construction by utilizing a photohardenable layer for layer 102. The term "photohardenable" means that the material undergoes a change upon exposure to actinic radiation that alters its solubility characteristics to a developing solvent. Thus, exposed portions of layer 102 harden to withstand the action of developer, which removes unexposed portions. Suitable photohardenable materials are well-known in the art, and a comprehensive list of such materials is set forth in U.S. Pat. Nos. 4,596,760, 3,181,461,and 4,902,976, the entire disclosures of which are hereby incorporated by reference. Most typically, the actinic radiation used to harden the photopolymer is within the visible or ultraviolet ("UV") portions of the electromagnetic spectrum.

Figure 3:
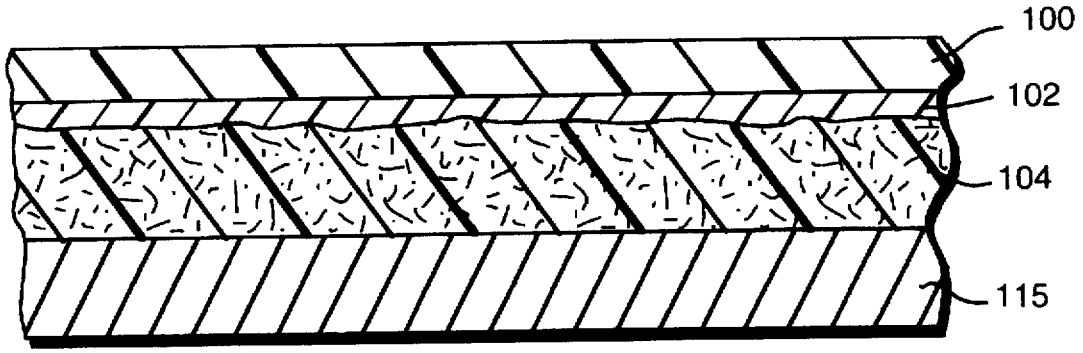
FIG. 3 is an enlarged sectional view of a variation of the embodiment shown in FIG. 1, and which contains a substrate layer.
Figure 4:
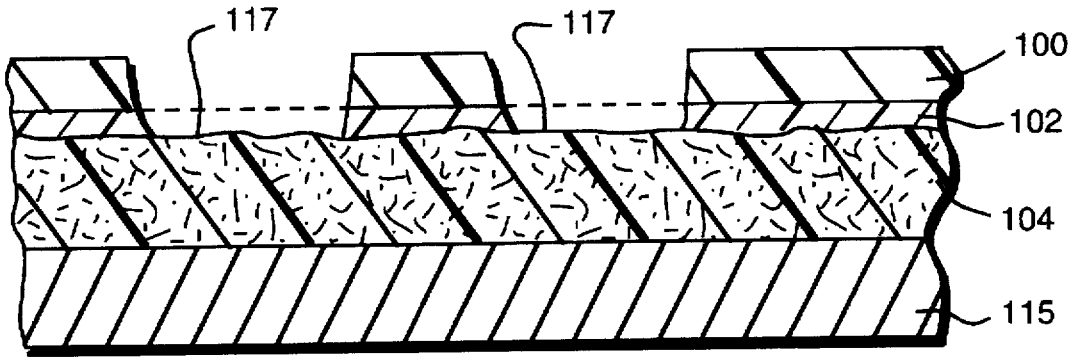
FIG. 4 shows the manner in which the printing member illustrated in FIG. 3 may be imaged.
Figure 5:
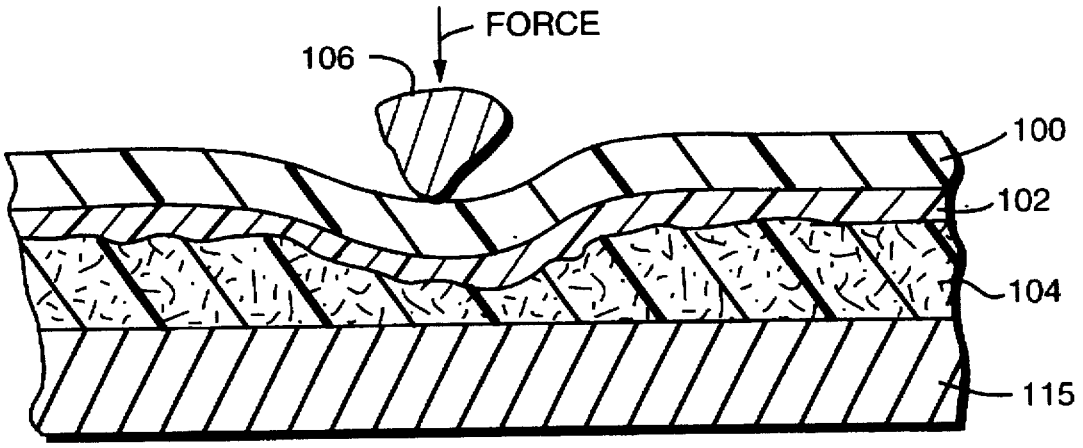
FIG. 5 shows the manner in which the printing member illustrated in FIG. 3 reacts to application of an impinging force.

As shown in FIGS. 3–5, it is also possible to utilize a relatively thin (generally 0.0005 to 0.005 inch) layer coated onto a strong, stable and flexible substrate 115, which may be a polymer film, or a paper or metal sheet. Polyester films (in one embodiment, the MYLAR film sold by E.I. dupont de Nemours Co., Wilmington, Del., or, alternatively, the Melinex film sold by ICI Films, Wilmington, Del.) furnish useful examples. A preferred polyester-film thickness is 0.007 inch, but thinner and thicker versions can be used effectively. Aluminum is a preferred metal substrate. In general, metal is preferred as a substrate for sheet plates due to its dimensional stability. Paper substrates are typically "saturated" with polymerics to impart water resistance, dimensional stability and strength.

Alternatively, it is possible to utilize the approach described in U.S. Pat. Nos. 5,188,032 and 5,570,636 (the entire disclosures of which are hereby incorporated by reference). As discussed in the '636 patent, a metal sheet can be laminated either to the substrate materials described above, or instead can be utilized directly as a substrate and laminated to compressible layer 104. Suitable metals, laminating procedures and preferred dimensions and operating conditions are all described in the '032 patent and the '636 patent, and can be straightforwardly applied to the present context without undue experimentation. In this case, the laminating adhesive can serve as the compressible layer.

FIG. 4 illustrates the manner in which this type of construction is imaged. Exposure of the printing member to a laser pulse ablates the absorbing layer 102, weakening the topmost layer 100 as well. As a result of ablation of the layer 102, the weakened surface layer 100 is no longer anchored to an underlying layer, and is easily removed (along with any debris remaining from destruction of the absorptive second layer) in a post-imaging cleaning step. This creates image spots 117 having a different affinity for the ink or ink-abhesive fluid than the unexposed layer 100. Post-imaging cleaning can be accomplished manually, or by using a contact cleaning device such as a rotating brush or other suitable means as described in U.S. Pat. No. 5,148,746 (with or without the assistance of a cleaning solvent such as naphtha or alcohol).

As shown in FIG. 5, application of point forces to the surface of layer 100 results in compression of layer 104, which additionally serves to protect the underlying substrate 115 against deformation.

Figure 6:
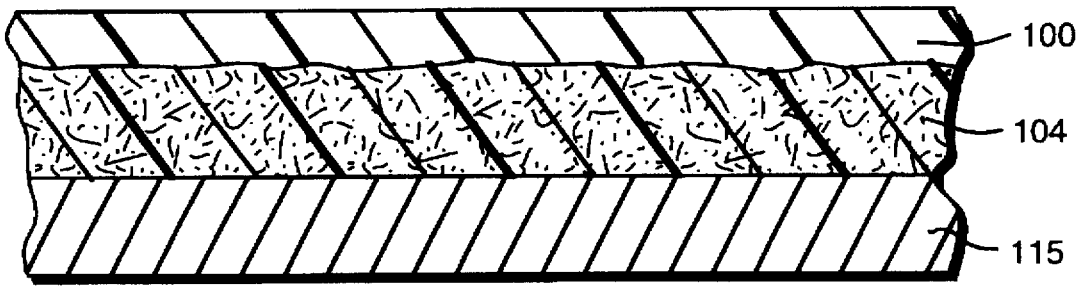
FIG. 6 is an enlarged sectional view of a second embodiment of the invention, in which the compressible layer ablates at least partially in response to an imaging pulse.
Figure 7:
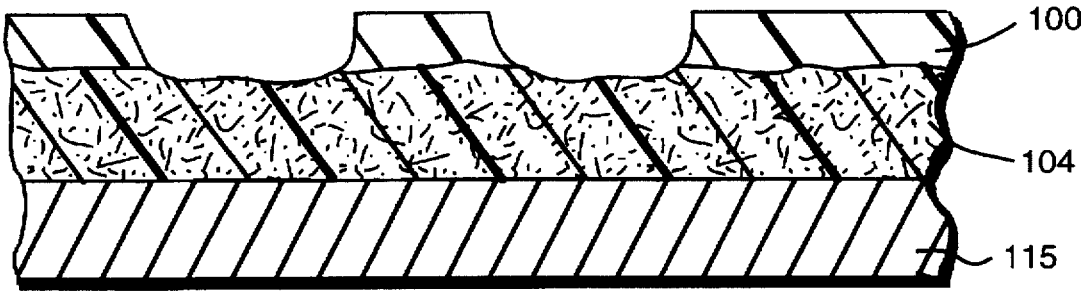
FIG. 7 shows the manner in which the printing member illustrated in FIG. 6 (and having a partially ablative compressible layer) may be imaged.
Figure 8:
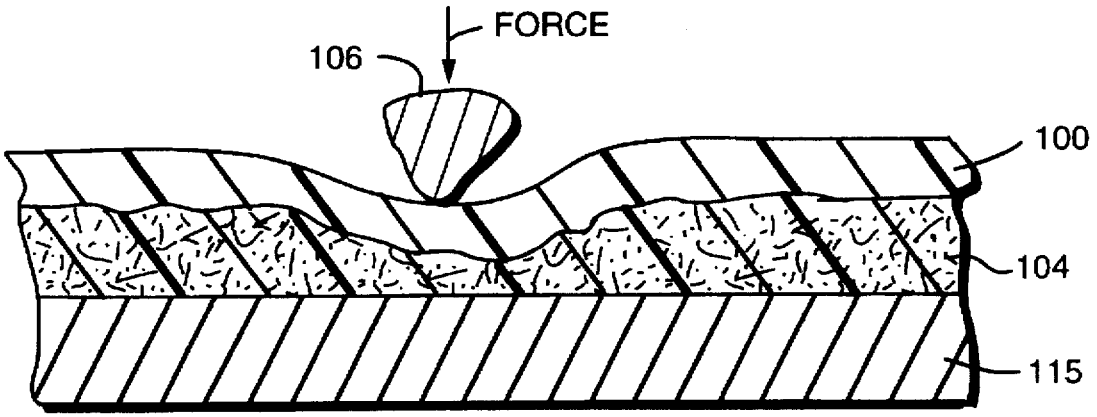
FIG. 8 shows the manner in which the printing member illustrated in FIG. 6 reacts to application of an impinging force.

Refer now to FIGS. 6–8, which illustrate a simpler embodiment having a topmost layer 100 that either ablates in response to imaging radiation or is easily removed following ablation of a portion of compressible layer 104. In the former case, layer 100 contains a pigment, dye or chemically integral chromophore that absorbs imaging radiation, while in the latter case this component is located in layer 104. Layers 100 and 104 exhibit opposite affinities for ink or an ink-abhesive fluid. A substrate 115 may optionally be added to increase strength.

Alternatively, instead of utilizing layer 104 at a thickness that ensures only partial ablation, it can instead serve as the imaging layer, completely ablating in response to a laser pulse. In this case, layers 100 and 115 exhibit opposite affinities for ink or an ink-abhesive fluid. Of course, thicker layers 104 as contemplated above provide a greater degree of compressibility. Thicker layers also provide greater thermal shielding in the case of metal substrates 115.

A preferred absorptive pigment for layer 104, which is particularly useful with IR imaging pulses is Vulcan XC-72, a conductive carbon black pigment supplied by the Special Blacks Division of Cabot Corp., Waltham, Mass., at loading levels described in the '737 patent. Conductive carbon blacks tend to be highly structured and therefore assist in void formation.

This pigment can be used in connection with a nitrocellulose polymer system that includes a thermally activated blowing agent and a thermally activated cross-linker (e.g., Cymel 303 (hexamethoxymethylmelamine) supplied by American Cyanamid Corp. and a suitable catalyst). The resulting material can be coated onto substrate 115 to form an inelastic compressible layer. The cross-linker imparts a rigid, infusible structure that stabilizes the foam against collapse due to thermoplastic flow.

Alternatively, a nitrocellulose system can be used with silicate microspheres as discussed above.

When the compressible layer is partially or completely ablated, volatile decomposition ordinarily result, and some of these (particularly in the case of polyurethanes) can be harmful. Accordingly, the imaging system should contain gas-removal means for clearing these products from the imaging environment. One approach is to utilize the internal air manifold 155 shown in the '737 patent under vacuum, drawing debris and gases away from the imaging area through ports 160 (see col. 9, lines 59–63 of the '737 patent.

It will therefore be seen that I have developed a highly versatile and effective approach to fabrication of lithographic printing members that resist handling damage. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A deformable lithographic printing member directly imageable by laser discharge, the member comprising:

a. a first solid layer; and b. a second solid layer;

wherein c. the second layer is compressible and has a porous structure;

d. the first and second layers exhibit different affinities for at least one printing liquid selected from the group consisting of ink and an abhesive fluid for ink, the second layer being oleophilic;

e. the second layer, but not the first layer, comprises a material that is subject to ablative absorption of imaging radiation; and f. the first layer is elastomeric.

2. The member of claim 1 further comprising a solid substrate underlying the second layer.

3. The member of claim 1 wherein the first layer is oleophobic.

4. The member of claim 1 wherein the first layer is hydrophilic and the second layer is hydrophobic.

5. The member of claim 1 wherein the compressible layer is elastic.

6. The member of claim 1 wherein the compressible layer is inelastic.

7. The member of claim 1 wherein the compressible layer is a foamed polymer.

8. The member of claim 1 wherein the compressible layer comprises hollow particles.

9. A deformable lithographic printing member directly imageable by laser discharge, the member comprising:

a. a first solid layer;

b. a second solid layer; and c. a compressible layer having a porous structure and being disposed beneath the second solid layer;

wherein d. the first and compressible layers exhibit different affinities for at least one printing liquid selected from the group consisting of ink and an abhesive fluid for ink, the compressible layer being oleophilic;

e. the second layer, but not the first layer, comprises a material sensitive to imaging radiation; and f. the first layer is elastomeric.

10. The member of claim 9 wherein the second solid layer is a photohardenable polymer.

11. The member of claim 10 wherein the first layer is oleophobic.

12. The member of claim 9 wherein the first layer is hydrophilic and the compressible layer is hydrophobic.

13. The member of claim 9 wherein the second solid layer comprises a material that is subject to ablative absorption of imaging radiation.

14. The member of claim 13 wherein the first layer is oleophobic.

15. The member of claim 13 wherein the first layer is hydrophilic and the second layer is hydrophobic.

16. The member of claim 9 further comprising a solid substrate underlying the compressible layer.

17. The member of claim 16 wherein the substrate is metal.

18. The member of claim 9 wherein the compressible layer is elastic.

19. The member of claim 9 wherein the compressible layer is inelastic.

20. The member of claim 9 wherein the compressible layer is a foamed polymer.

21. The member of claim 9 wherein the compressible layer comprises hollow particles.

22. The member of claim 9 further comprising a substrate to which the first, second and compressible layers are laminated, the compressible layer serving to anchor the other layers to the substrate.

23. A deformable lithographic printing member directly imageable by laser discharge, the member comprising:

a. a first solid layer;

b. a second solid layer, said layer being compressible and having a porous structure;

wherein c. the first and second layers exhibit different affinities for at least one printing liquid selected from the group consisting of ink and an abhesive fluid for ink, the second layer being oleophilic;

d. the first layer, but not the second layer, comprises a material that is sensitive to imaging radiation; and e. the first layer is elastomeric.

24. The member of claim 23 wherein the first layer comprises a material subject to ablative absorption of imaging radiation.

25. The member of claim 23 wherein the second layer ablates partially in response to ablation of the first layer.

26. The member of claim 23 further comprising a solid substrate underlying the second layer.

27. The member of claim 26 wherein the substrate is metal.

28. The member of claim 23 wherein the first layer is oleophobic.

29. The member of claim 23 wherein the first layer is hydrophilic and the second layer is hydrophobic.

30. The member of claim 23 wherein the second layer is elastic.

31. The member of claim 23 wherein the second layer is inelastic.

32. The member of claim 23 wherein the second layer comprises hollow particles.

33. The member of claim 23 wherein the second layer is a foamed polymer.

* * * * *